US006378697B1

(12) United States Patent
Sutherland et al.

(10) Patent No.: US 6,378,697 B1
(45) Date of Patent: Apr. 30, 2002

(54) BEVERAGE MULTIPLE PACKAGING LOCK SYSTEM

(75) Inventors: Robert L. Sutherland, Kennesaw; James C. Fogle; Jean-Manuel Gomez, both of Marietta, all of GA (US)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/690,325

(22) Filed: Oct. 17, 2000

(51) Int. Cl.[7] ..... B65D 75/00
(52) U.S. Cl. ..... 206/140; 206/147; 206/434
(58) Field of Search ..... 206/140, 147, 206/427, 434; 229/103.2, 183, 198.2

(56) References Cited

U.S. PATENT DOCUMENTS

| | | | | | |
|---|---|---|---|---|---|
| 3,128,034 | A | * | 4/1964 | Weiss | 206/140 |
| 4,200,220 | A | * | 4/1980 | Ganz | 206/140 |
| 4,708,284 | A | * | 11/1987 | Sutherland et al. | 206/427 |
| 5,520,283 | A | * | 5/1996 | Sutherland | 206/434 |
| 5,524,756 | A | * | 6/1996 | Sutherland | 206/140 |
| 5,975,286 | A | * | 11/1999 | Oliff | 206/427 |
| 6,315,123 | B1 | * | 11/2001 | Ikeda | 206/434 |

* cited by examiner

*Primary Examiner*—David T. Fidei

(57) ABSTRACT

This invention relates to a primary and secondary locking system for wrap-around carriers. A secondary male lock is held in the vertical position by a female door flap leaning against the male lock.

13 Claims, 2 Drawing Sheets

BEVERAGE MULTIPLE PACKAGING LOCK SYSTEM

BACKGROUND OF THE INVENTION

1. Field of the Invention

This invention relates generally to mechanical locks for holding the overlapping flaps of a wrap-around carrier in place. More particularly, it relates to a secondary male locking panel and a secondary female locking panel. After the secondary male lock is inserted into the secondary female opening, a female door flap leans against the male lock holding it in a vertical position to prevent the lock from disengaging.

2. Prior Art

When fabricating a carrier from a paperboard blank, opposite ends of the blank are conventionally attached to each other by glue or by a mechanical lock to form the bottom panel of the carrier. In the case of a wrap-around carrier, flaps located on the ends of the blank typically are overlapped and engaged with one another by mechanical locks formed in the flaps to form the bottom panel of the carrier. Since the bottom panel must maintain its integrity throughout the use of the carrier, it is essential that the locking system be capable of supporting the weight of the packaged articles, and remain engaged during shipping and handling of the constructed carrier.

One approach to provide such a stable mechanical lock assembly utilizes primary and secondary locks. The primary locks connect the ends of the carrier together via the flaps, while the secondary locks function to maintain the engaged flaps in place in order to provide a "backup" locking system to prevent the primary locks from separating.

It would be advantageous to provide a mechanical locking system that has a method for holding the secondary male tab in a vertical position when locked. This would prevent the secondary locks from disengaging, which could result in the lock panels stretching apart from each other. The present invention provides such a locking system that holds the secondary male tab in the vertical position when locked.

SUMMARY OF THE INVENTION

Briefly described, in a preferred form, it is an object of the present invention to provide a secondary lock system that is more secure and does not become accidentally unlocked resulting in the carrier becoming opened discharging the bottles contained therein.

The object of this invention is achieved by providing both primary and secondary lock systems. The primary lock system secures the carrier around the bottles. The secondary system ensures that the primary locks do not become unlocked. The secondary lock system has a male lock that is inserted into the female opening and held in the vertical position in the carrier by a flap in the female lock system. An arcuate tab on this flap aids in holding the secondary male lock in the vertical position.

These and other objects, features, and advantages of the present invention will become more apparent upon reading the following specification in conjunction with the accompanying drawing figures.

DETAILED DESCRIPTION OF THE PREFERRED EMBODIMENTS

The present invention is intended primarily for use with wrap-around carriers containing bottles of the types used to contain soft drinks, beer and the like. A typical example of such a bottle has a generally cylindrical body with an upper portion and a bottom, a tapering shoulder smoothly continuous with the upper portion of the body, and a neck formed on the shoulder having a smaller diameter than the body. This conventional bottle B also has a neck flange projecting outwardly from the neck, and a cap attached to the upper end of the neck flange.

Figure 1:
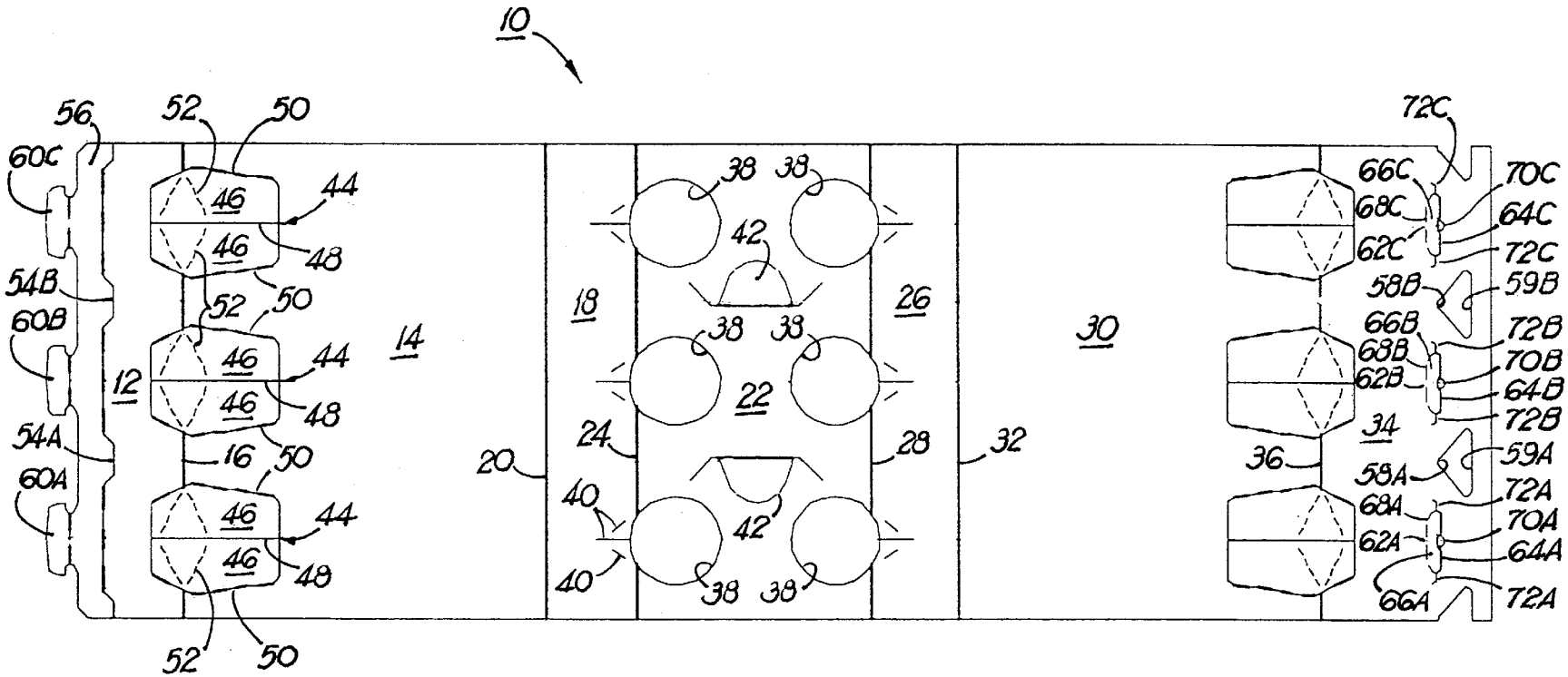
FIG. 1 is a plan view of a blank which incorporates the locking features of the present invention.
Figure 2:
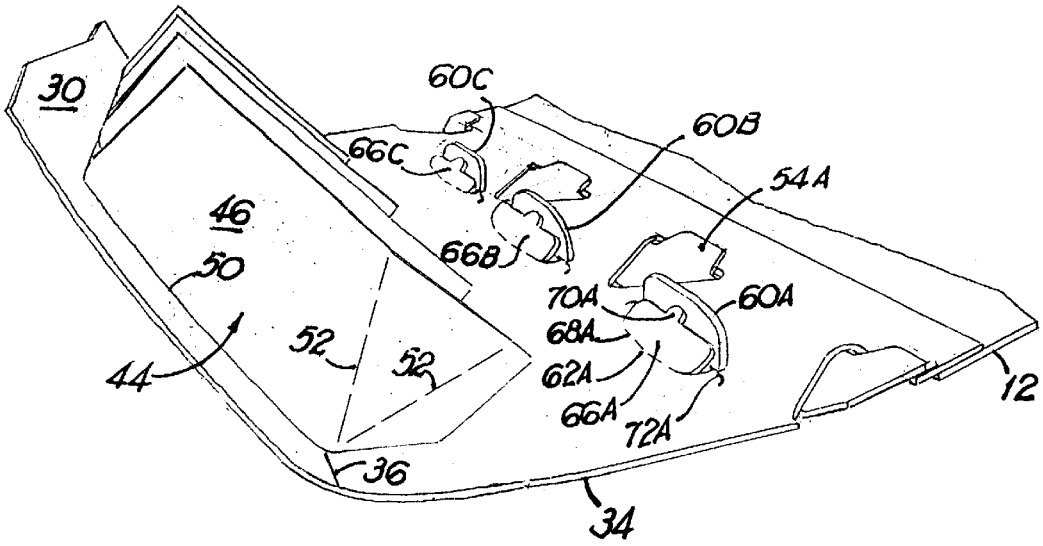
FIG. 2 is a perspective view of the secondary lock system of this invention.

The blank for forming the carrier of this invention is illustrated in FIG. 1. This blank 10 is designed to contain six beverage bottles B arranged in two rows of three each. The blank 10 is formed from a foldable sheet of material, such as paperboard. The blank has a bottom panel 12, which is foldably connected to a lower side panel 14 by fold line 16, and in turn is connected to an upper side panel 18 by fold line 20. Upper side panel 18 is connected to top panel 22 by fold line 24, and in turn connected to upper side panel 26 by fold line 28. Upper side panel 26 is connected to lower side panel 30 by fold line 32. Lower side panel 30 is connected to bottom flap 34 by fold line 36.

It will be understood by those in the art that the preferable carrier is symmetrical about a horizontal line of bisection, as viewed from FIG. 1. This symmetry aids in the efficient production of the present carrier. The carrier need not have such symmetry, although it is preferred. As shown, the blank 10 is rectangular in shape and includes straight edges, which also makes for an efficient layout of the blank in a web from which the blanks are cut.

The top panel has apertures 38 through which the necks of bottles B extend. Because the bottles necks may have variations in diameter, slits 40 may be provided to accommodate bottles with slightly greater diameters. Cuts 42 may be provided so that the thumb and finger of a person may be inserted for carrying the carrier.

Figure 3:
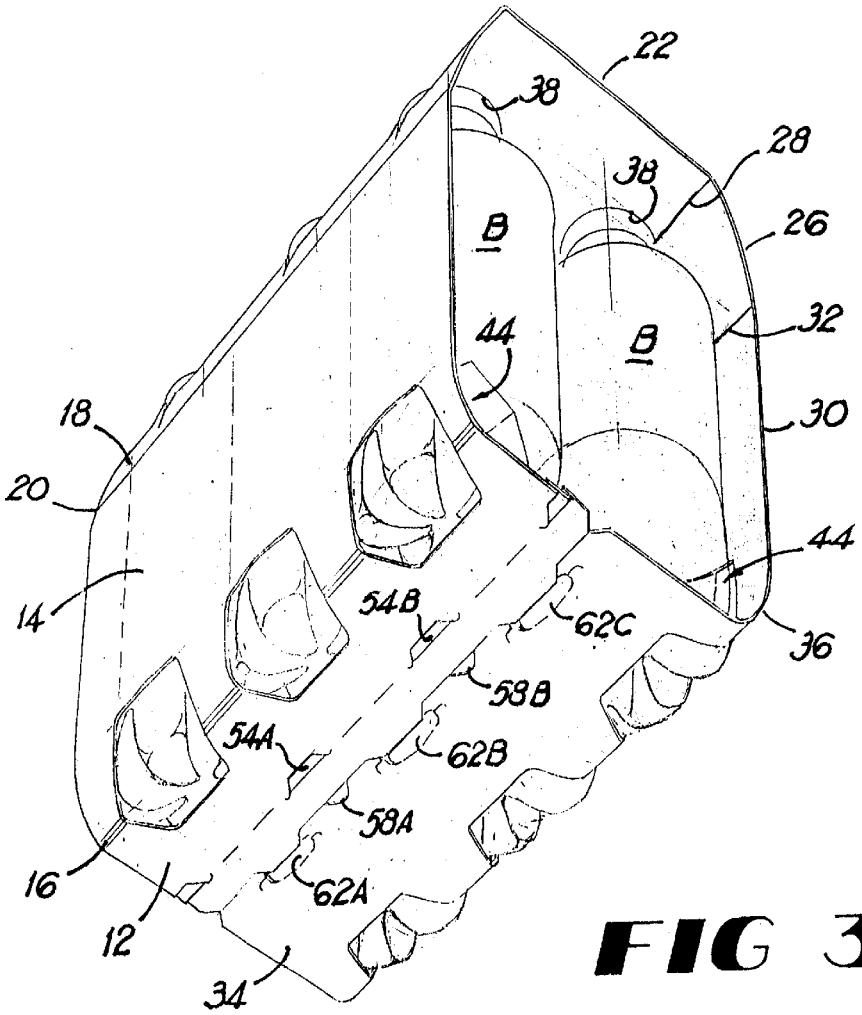
FIG. 3 is a perspective view of the blank of FIG. 1 in a set up condition and containing bottles.

The heels of the bottles B may be restrained from movement by the provision of heel retaining assemblies 44, or other suitable means for retaining the heels of the bottles from movement within the carrier. These heel retaining assemblies also permit the carrier to be tightly locked in that a portion of the heel of the bottle B can extend through the heel retaining assembly 44. These heel retaining assemblies are all identical. Heel doors 46 are provided in the bottom of the lower side panels 14 and 30 and extend into the bottom flaps 12 and 34 through the fold lines 16 and 36. These doors open inwardly during the erection of the carrier from a cut line 48 between each set of heel doors 46. These doors are hinged to the panels and flaps by fold lines 50. These fold lines 50 permits the heel doors 46 of the carrier to be swung inwardly during erection. This permits each bottle B to be nested between a set of adjacent heel doors 46 of the heel retaining assembly 44. This facilitates holding each bottle B in proper position as illustrated in FIG. 3. More importantly, these doors tend to restrain tearing around the heel apertures that are formed by these doors. Without these doors 46, there would only be cuts that could easily be torn. Further, these doors 46 provide a flexible buffer against which the heel of the bottle can abut without tearing the carrier panel surrounding the heel retaining aperture.

Cut lines 52 may be formed in each set of doors to reduce the stress on the paperboard around the heel of the bottle.

The door opening allows a relative large portion of the heel of the bottle to be inserted into the aperture formed by the doors' opening, thereby enabling a relative strong pack to tighten while minimizing the risk of tearing.

The locking system of the present invention includes both a primary locking system and a secondary locking system. The primary locking system is the locking arrangement between primary male locks 54A and 54B in primary lock panel 56, and primary female openings 58*a* and 58*b*. The primary male locks 54A and 54B are hooked over primary female ledges 59A and 59B in the locking of the carrier. As it is important to tighten the carrier tightly about the bottles, primary female openings 58A and 58B also serve as tightening apertures, which allow mechanical tightening fingers to enter and tighten the carrier during forming.

The primary locks connect the ends of the carrier together via the flaps, while secondary locks function to maintain the engaged flaps in place in order to provide a "backup" locking system to prevent the primary locks from separating.

The secondary locking system consist of male locks 60A–C formed as an extension of bottom flap 12 and female openings 62A–C formed in bottom flap 34. Female openings are formed by cut lines 64A–C producing female flaps 66A–C. These flaps can be folded around fold line 68A–C. These flaps may have arcuate tabs 70A–C, whose function will be described infra. This invention provides a locking system that is more secure then prior art locking systems. While the primary locks connect the ends of the carrier together, the secondary locks keep the primary locks engaged. The secondary locks are secured in that the secondary male locks 60A–C are held in the vertical position in respect to the carrier by the secondary female flap 66A–C and the arcuate tab 70A–C on the ends of the lock of the flap. If the secondary male lock 60A–C were allowed to be parallel to the bottom flaps 12 and 34, they could easily become disengaged.

The carrier of this invention is formed from the blank of FIG. 1 by moving the top panel 22 of the blank so that a portion of the necks of a group of bottles B extend up through the apertures 38. The blank 10 is pulled tight about the bottles B and the bottom flaps 12 and 34 are overlapped with bottom flap 12 being on the outside. The primary male locks 54A and 54B are punched inward into primary female openings 58*a* and 58*b*, and are locked on primary female ledges 59A and 59B.

The secondary male locks 60A–C are pushed inwardly into the aperture formed when secondary female flaps 66A–C is pushed inwardly by secondary male locks 68A–C. Cut lines 72A–C facilitate the insertion of secondary male locks 60A–C into secondary female openings 62A–C.

Secondary male locks 60A–C are held in a vertical position by secondary female flaps 66A–C. The arcuate tab 70A–C on each secondary female flap 66A–C leans against the secondary male lock 60A–C and assist in holding the secondary male lock 60A–C in the vertical position. Holding the secondary male locks 60A–C in the vertical position ensures that the locks are not accidentally withdrawn. The secondary lock system serves the function of ensuring that the primary lock system does not become undone. The holding of the secondary male locks 60A–C by the secondary female flaps 66A–C and arcuate tabs 70A–C is illustrated FIG. 3.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A wrap-around article carrier for carrying articles comprising;

(a) a top panel, opposite side panels and a bottom panel;

(b) the bottom panel having inner and outer panel flaps, a portion of the outer panel flap overlapping a portion of the inner panel flap;

(c) the inner panel flap having at least one lock ledge formed by an opening cut in the inner panel flap;

(d) the outer panel flap having at least one primary lock for each lock ledge, formed by a slit cut in the outer panel flap;

(e) the outer panel flap having at least one secondary male lock formed as an extension of the flap;

(f) the inner panel having at least one secondary female opening for each secondary male lock, said secondary female opening formed by a slit and fold line which forms a flap in the female opening, said flap leaning against the secondary male lock when it has been extended through the female opening to assist in holding the secondary male lock in a vertical position with respect to the outer flap so the lock does not become accidentally disengaged, the slit forming the flap on the secondary female opening is substantially parallel to and closer to the end of the inner flap than the fold line by which the flap in the female opening is connected to the bottom panel flap.

2. The carrier of claim 1, wherein each flap formed from the secondary female opening has an arcuate tab formed by the slit forming the female opening.

3. The carrier of claim 1, wherein each article has a heel, the carrier further comprising heel retaining assemblies to retain the heels of article.

4. The carrier of claim 3, wherein each heel retaining assembly comprises a set of heel doors attached to the side panels of the carrier by fold lines.

5. The carrier of claim 1, wherein there are two spaced apart primary male locks, two spaced apart lock ledges, three spaced apart secondary male locks and three spaced apart secondary female openings.

6. The carrier of claim 4, wherein there are two spaced apart primary male locks, two spaced apart lock ledges, three spaced apart secondary male locks and three spaced apart secondary female openings.

7. A bottom panel in an article carrier comprising:

(a) inner and outer panel flaps, a portion of the outer panel flap overlapping a portion of the inner panel flap;

(b) the inner panel flap having at least one lock ledge formed by an opening cut in the inner panel flap;

(c) the outer panel flap having at least one primary lock for each lock ledge, formed by a slit cut in the outer panel flap;

(d) the outer panel flap having at least one secondary male lock formed as an extension of the flap;

(e) the inner panel having at least one secondary female opening for each secondary male lock, said secondary female opening formed by a slit and fold line which forms a flap in the female opening, said flap leaning against the secondary male lock when it has been extended through the female opening to assist in holding the secondary male lock in a vertical position with respect to the outer flap so the lock does not become accidentally disengaged, the slit forming the flap on the secondary female opening is substantially parallel to and closer to the end of the inner flap than the fold line by which the flap in the female opening is connected to the bottom panel flap.

8. The bottom panel of claim 7 wherein each flap formed from the secondary female opening has an arcuate tab formed by the slit forming the female opening.

9. The bottom panel of claim 7 wherein there are two spaced apart primary male locks, two spaced apart lock ledges, three spaced apart secondary male locks and three spaced apart secondary male openings.

10. A blank for forming a wrap-around carrier comprising a generally rectangular sheet, said sheet comprising:

(a) at one end of the sheet an inner panel flap having at least one lock ledge formed by an opening cut in the inner panel flap and having at least one secondary female opening for an associated secondary male lock, said opening formed by a slit and fold line which forms a flap in the female opening;

(b) a side panel, a top panel, and an opposite side panel foldably connected to the inner panel flap in that order;

(c) an outer panel flap foldably connected to the opposite side panel and having at least one primary lock for each lock ledge in the inner panel flap, said primary lock being formed by a slit cut in the outer panel flap, said outer panel flap having at least one secondary male lock formed as an extension of a flap, the slit forming the flap on the secondary female opening is substantially parallel to and closer to the end of the inner flap than the fold line by which the flap in the female opening is connected to the bottom panel flap.

11. The carrier of claim 10 having two spaced apart primary male locks, two spaced apart lock ledges, three spaced apart secondary male locks and three spaced apart secondary female openings.

12. The blank of claim 10 wherein each flap formed from a secondary female opening has an arcuate tab formed by a slit forming the female opening.

13. The blank of claim 10 which further comprises heel retaining assemblies to retain the heels of articles to be contained in the blank when it is formed into a wrap-around article carrier.

* * * * *